US005544880A

United States Patent [19]

Borg

[11] Patent Number: 5,544,880

[45] Date of Patent: Aug. 13, 1996

[54] PINBALL MACHINE WITH BALL THROWING FIGURE

[75] Inventor: John D. Borg, Lisle, Ill.

[73] Assignee: Sega Pinball, Inc., Melrose Park, Ill.

[21] Appl. No.: 372,156

[22] Filed: Jan. 13, 1995

[51] Int. Cl.[6] ..... A63F 7/02

[52] U.S. Cl. ..... 273/119 R; 273/118 R; 273/118 A; 273/119 A; 273/121 A; 273/129 R; 273/129 V

[58] Field of Search ..... 273/118–121, 129 R, 273/129 V

[56] References Cited

U.S. PATENT DOCUMENTS 5,123,647 6/1992 Lawlor et al. ..... 273/121 A
5,186,462 2/1993 Biagi et al. ..... 273/129 V X
5,330,182 7/1994 Kaminkow .
5,356,142 10/1994 Borg et al. ..... 273/121 A
5,358,244 10/1994 Kaminkow et al. .
5,405,142 4/1995 Arad et al. ..... 273/118 A X

*Primary Examiner*—Raleigh W. Chiu
*Attorney, Agent, or Firm*—Gerstman, Ellis & McMillin, Ltd.

[57] ABSTRACT

A pinball machine comprises a playfield, a shooter for propelling balls on the playfield, and a figure having at least one movable limb. The limb is movable between a first position where the limb is capable of receiving and holding a ball, and a second position where the ball is propelled from the limb onto the playfield. A motor/solenoid and shaft are provided for moving the limb between the first and second positions to propel the ball from the limb, and then to retract the limb back to the first position. A ball delivery trough is positioned to deliver balls to the limb in the first position.

16 Claims, 3 Drawing Sheets

FIG. 2
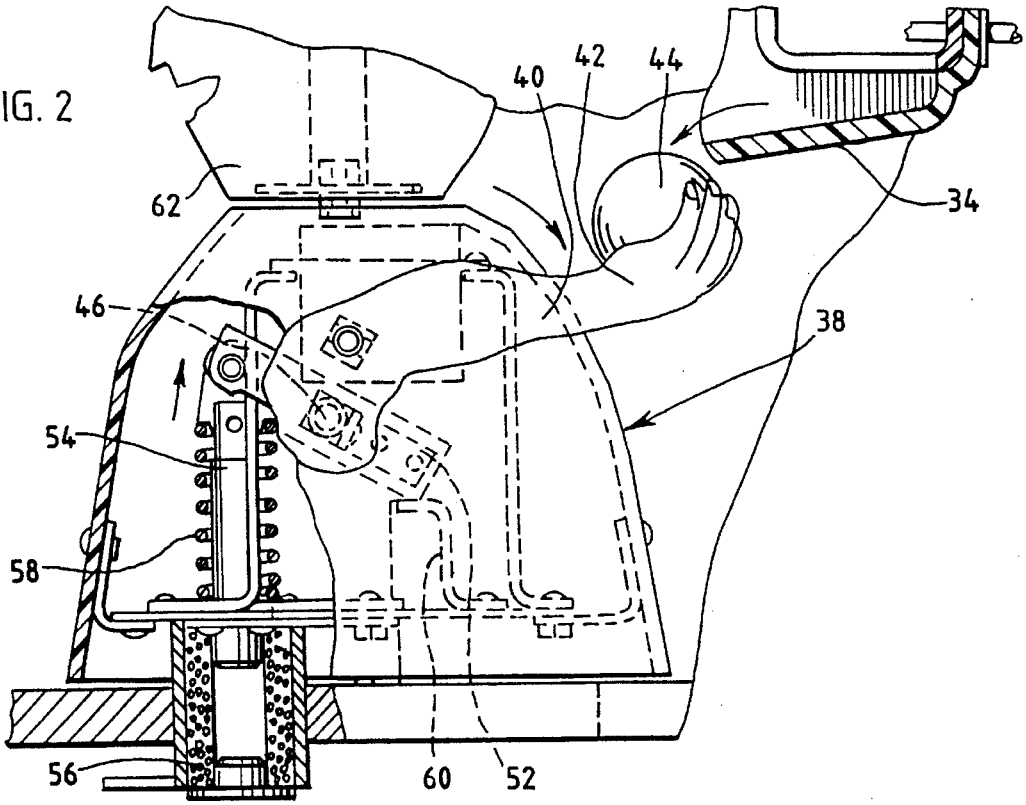
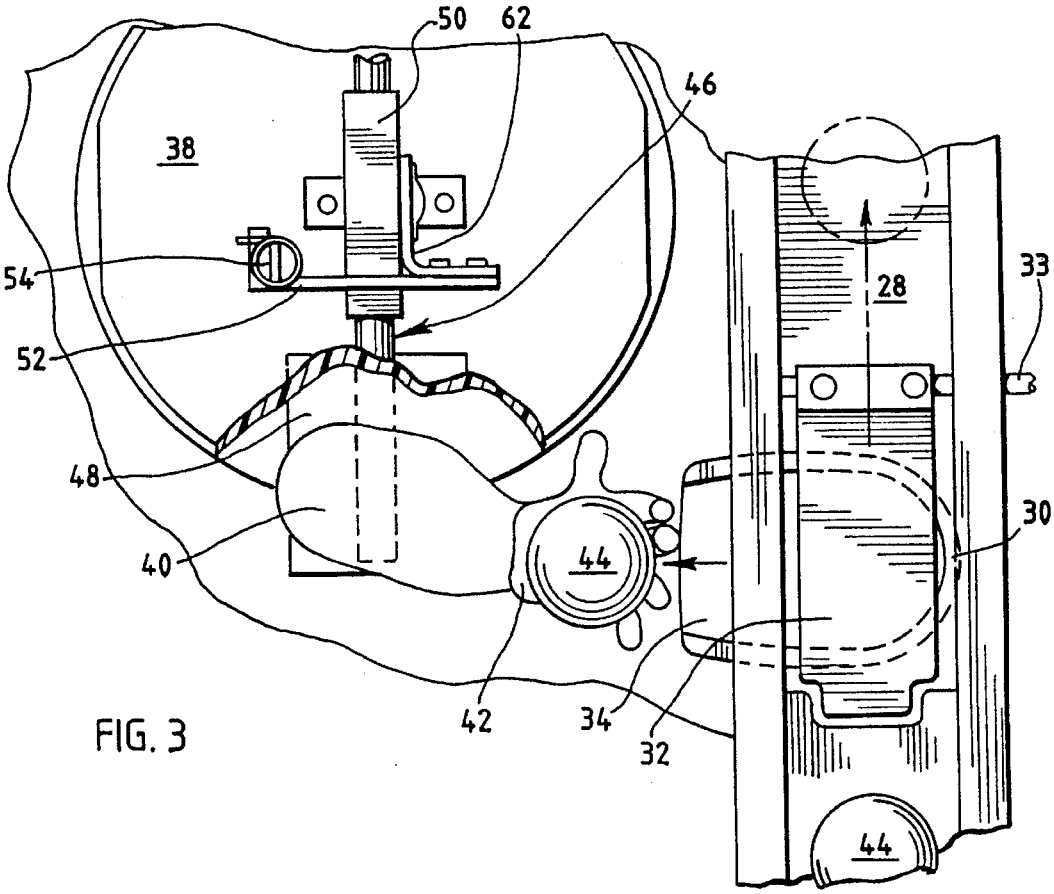
FIG. 3

FIG. 4
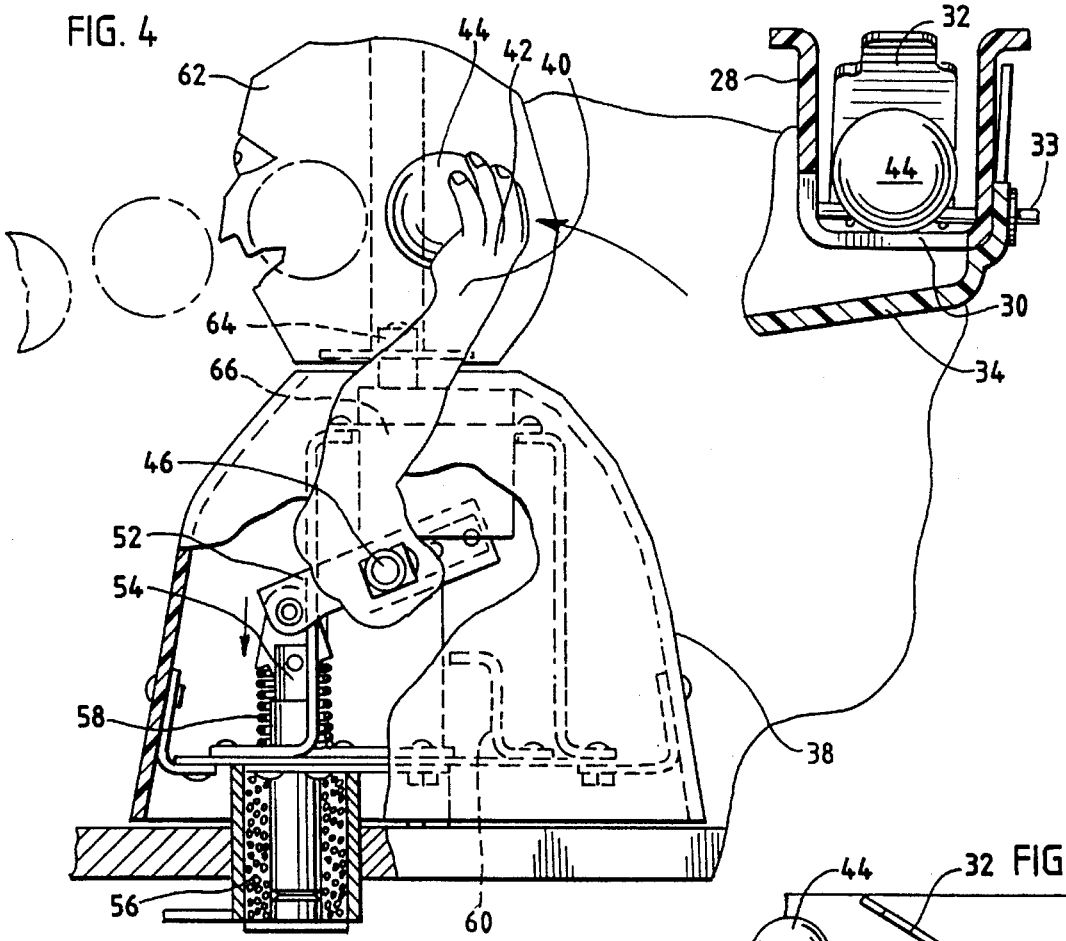
FIG. 6
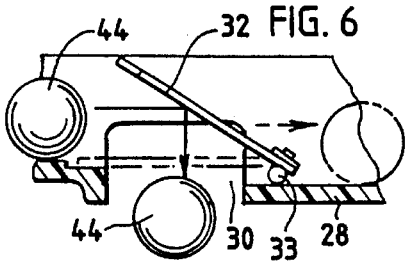
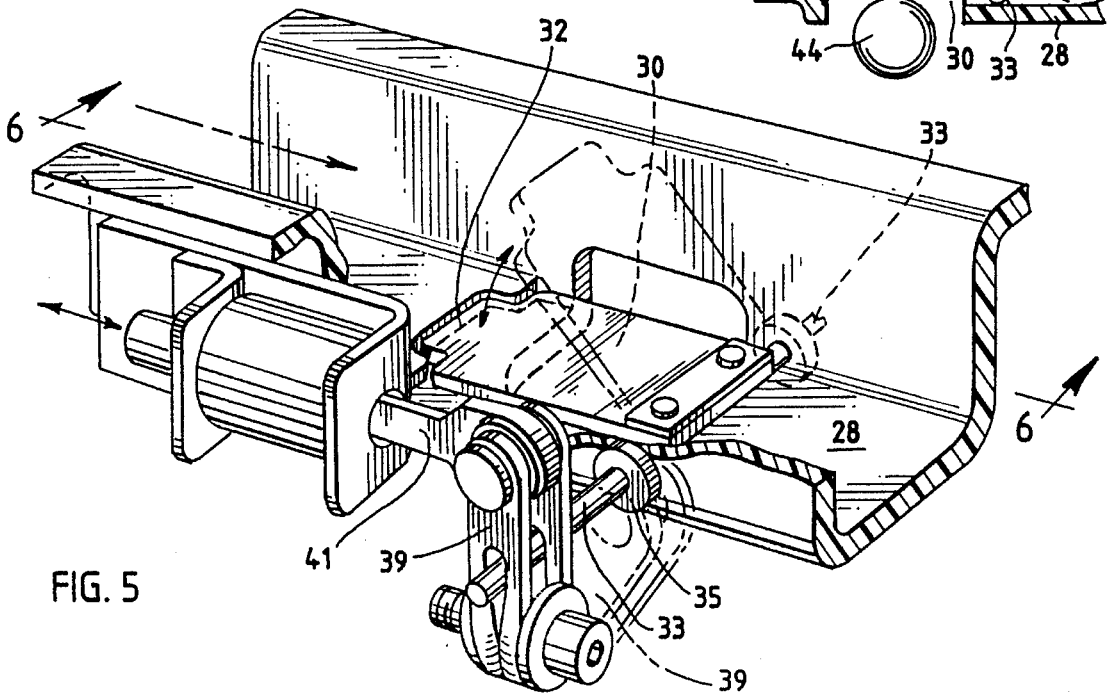
FIG. 5

PINBALL MACHINE WITH BALL THROWING FIGURE

BACKGROUND OF THE INVENTION

The manufacturers of pinball games are always looking for new features and activities that can be applied to the pinball game to add interest and excitement. Previously, moving, three dimensional figures have been provided on the pinball game playfield, for example a dinosaur with a moving head as disclosed in Kaminkow et al. U.S. Pat. No. 5,358,244, or figures of animals or people which may have a moving arm or the like as disclosed in Kaminkow U.S. Pat. No. 5,330,182.

By this invention, an improved moving figure, human or animal, is provided for the entertainment of the player and the action of the game.

DESCRIPTION OF THE INVENTION

By this invention, a pinball machine is provided which comprises a playfield, a shooter for propelling balls on the playfield, and a figure representative of typically a human, an animal, or another fictional figure which has at least one movable limb and preferably a pair of them, for example movable arms. However, movable feet or a movable tail might also be used if desired. Alternatively, the entire figure may be movable along with the limb, if desired.

The movable limb is movable between a first position where the limb is capable of receiving and holding a ball, and a second position where the ball is propelled from the limb to simulate the throwing of the ball with the arm, kicking of the ball with the foot, or the like.

A system is provided for moving the limb between the first and second positions to propel the ball from the limb, and then to retract the limb back to the first position. Also, a ball delivery trough is positioned to deliver balls to the limb in the first position.

The limb or the limbs of the figure may typically be mounted on a rotatable shaft. The shaft may be pivotally connected to a motor such as a solenoid to cause pivoting of the limbs to at least one of the positions. If desired, when the motor/solenoid is shut off, a spring member can push the limb back to the other position. Alternatively, a stepper motor or the like can be used to positively control movement of the limb between both positions, or all of the positions when more than two positions are used.

The limb may communicate, or a pair of limbs may each communicate, in the first position with a separate ball delivery aperture defined either in a single ball delivery trough, or, if desired, a pair of separate ball delivery troughs. Electrically controllable gates may be provided for opening and closing the apertures, so that balls may be stored in the delivery trough or troughs, and then delivered through the aperture of apertures at an appropriate time in the pinball game as controlled by the electronics. For example, the aperture or apertures may be opened when a certain series of targets have been hit by other balls, in the game, or the like. When the aperture or apertures are opened, the balls roll from a trough into an artificial hand, for example, at the end of an arm of the figure. Following this, the figure "throws" the ball by moving the arm or arms between the first and second positions.

The gate that controls the passage of the ball through an aperture in the trough may comprise a movable flap capable of covering the aperture in a first position, and capable of permitting a ball rolling in the trough to pass through the aperture in a second position. A second motor such as a solenoid unit may control the position of the movable flap. The solenoid unit comprises an electromagnet which is capable of moving the flap to one of the flap positions. A spring in the solenoid may cause the flap to return to the other position when the electromagnet is not actuated.

Accordingly, by this invention a figure, for example a moving Frankenstein figure, may receive balls with one or both hands and, at a proper moment in the game, throw them onto the playfield for added variety and interest of game play.

DESCRIPTION OF DRAWINGS

In the drawings.

FIG. 2 is an enlarged elevational view, taken partly in section, showing the movable figure located on the playfield and showing a movable limb in its first, ball-holding position;

FIG. 3 is a transverse sectional view taken through the movable figure along lines 2—2;

FIG. 4 is a longitudinal sectional view similar to FIG. 2, but showing the movable limb in its second or throwing position.

FIG. 5 is a detailed perspective view of the ball aperture and gate mechanism for feeding balls to the limbs of the figure; and FIG. 6 is a fragmentary elevational view of the ball aperture and gate mechanism taken along line 6—6 of FIG. 5.

DESCRIPTION OF SPECIFIC EMBODIMENTS

Figure 1:
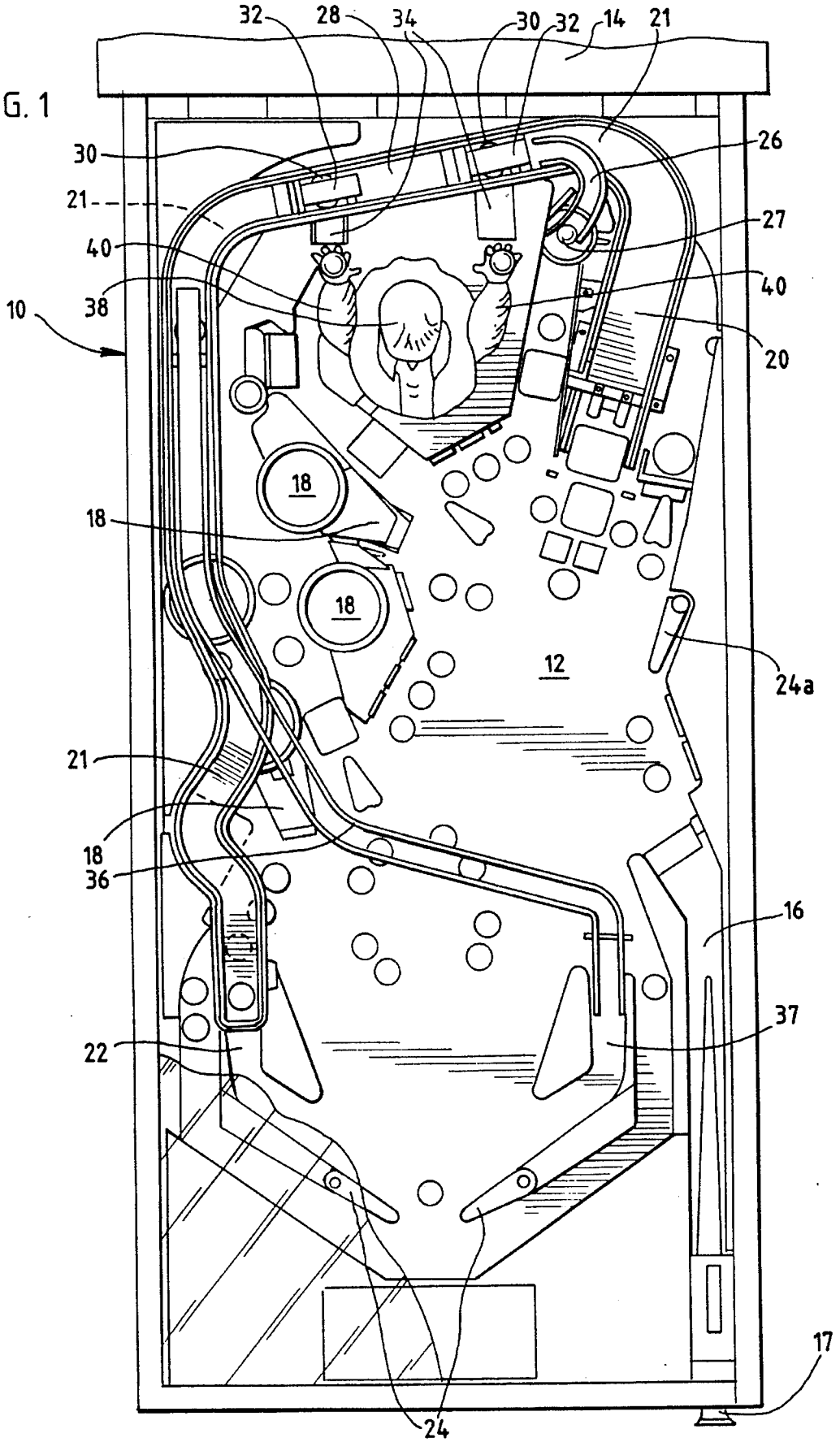
FIG. 1 is a plan view of a pinball game of this invention, showing the playfield.

Referring to the drawings, a pinball machine 10 is shown comprising a playfield 12 which is carried on a conventional frame for pinball machines, plus a backboard 14 which may also be of conventional design. A shooting lane 16 and a shooter 17 is provided for either manually or automatically launching balls onto the playfield 12, all of which is conventional in the construction and use of pinball machines.

Playfield 12 defines numerous targets 18 of various kinds, with the particular playfield defining a target ramp 20, which leads to trough 21. Trough 21 directs a ball around the general periphery of the playfield to carry it to the left return lane 22 which, in turn, directs the ball to flippers 24. As is conventional, the player has manual control of the flippers, and thus has an opportunity to propel balls from return lane 22 back out into the playfield again.

Another ball chute 26 is provided, sloping upwardly from a vertical up-kicker 27. Chute 26 leads to a larger trough 28 which is positioned above trough 21. Trough 28 defines a pair of ball receiving apertures 30 in its bottom wall, details of which are shown in FIGS. 5 and 6. A flap member 32 is rotatable between a closed position in which it covers the associated aperture 30, shown in phantom in FIG. 6, and an open position, in which the ball 44 is blocked from rolling along trough 28 and thus directed downwardly through aperture 30 to a side chute 34.

Each flap 32 is carried on a rotary shaft 33 (FIG. 5), which is retained in journals 35. Flap 32 is raised and lowered by the action of solenoid shaft 41, which causes pivotally attached beam 39 to rock back and forth as shaft 41 moves to rotate shaft 33, thus opening and closing flap 32. Beam 39 is attached to shaft 33 with a frictional pressure attachment.

Upper trough 28 is positioned so that its greatest elevation is adjacent its junction with chute 26, with trough 28 sloping gradually downwardly so that a ball will roll over the flap members 32 if they are in the closed position, following the upper trough 28 along the periphery of the playfield and over lower trough 21. Then, upper trough 28 joins with a track 36 comprising a pair of metal rods, to direct balls received from trough 28 across the width of the playfield, as shown, to the right return lane 37. Here also, balls from the right return lane 37 may be directed by the player out into the playfield again by the use of flippers 24.

Upper flipper 24*a* may also be provided for the player's use.

The playfield 12 also carries a FIG. 38, which is typically that of a human, animal, or some monster or alien. FIG. 38 is shown in this embodiment to have a pair of limbs 40, which are specifically arms having ball receiving hands 42.

FIG. 2 shows FIG. 38 with its arms in a first, ball-receiving position. Each of chutes 34 communicates to deliver a ball 44 from bottom aperture 30 to a hand 42 of the figure when arm 40 is in the ball-receiving position. This can be accomplished by opening one of the trap doors or flap members 32, to cause a ball rolling in trough 28 to be diverted through one of the apertures 30 rather than rolling on through trough 28 to track 36.

The game may be programmed through a microprocessor to actuate one of the trap doors 32 or both of them in sequence, so that balls are caught and delivered to the hands 42 of the creature so that either one or both of the hands carry a ball.

The arms 40 of the creature are pivotally carried on a shaft 46. Shaft 46 is carried in journals 48, having end portions of round cross section, portions, with the arms being carried on the outer ends of the shaft. A central portion 50 of shaft 46 may be of square cross section, carrying an apertured pivot plate 52, which is connected at one end to the plunger 54 of an electromagnet or solenoid 56. A coil spring 58 biases plunger 54 and pivot plate 52 into the position 56 shown in FIG. 2, while activation of solenoid causes the arrangement to assume the position of FIG. 4.

Shaft 46 and arm 40 are limited in their clockwise pivoting by the impingement of plate 52 against bracket 60, as shown in FIG. 2. L bracket 62 is attached at one leg to plate 52 and at the other leg to the square cross section portion of shaft 50, for purposes of strengthening and positioning plate 52.

Thus, after a hand or both hands 42 of the creature 38 have received a pinball 44 from the respective chutes 34, solenoid 56 may be actuated by the control system of the pinball game, to cause both arms 40 to be forcefully moved from the position of FIG. 2 to the position of FIG. 4. The effect of this is to cause ball or balls 44 to be thrown out onto the playfield for further play action, as indicated by FIG. 4. Then, upon deactivation of solenoid 56, spring 58 causes shaft 46 and arms 40 to retract back to their original, first, ball-receiving position of FIG. 2.

Accordingly, a pinball game can be provided in which a figure such as Frankenstein throws balls back at the player as the player is shooting the balls at the figure. The player typically must make a predetermined score or light several targets, followed by the successful placement of the ball into the vertical up kicker 27, which is a known device to forcefully elevate and propel the ball. In this case, the ball is propelled into chutes 26 and 28 where, if a flap member or trap door 32 is raised, the ball will be directed to one of the hands 42 of the figure. Then, at a time predetermined by the operating system of the pinball game, the figure will throw the ball or balls back at the user for further play and scoring. If the flaps 32 are in closed position, then the ball or balls will roll on from trough 28 to rails 36, and from there to return lane 37.

If desired, head 62 of FIG. 38 may be carried on a horizontal pivot 64, to permit head 62 to be rotated from side-to-side by the action of motor 66 in a manner that is determined by the operating system of the pinball game. It is further possible for the entire body of the FIG. 38 to be similarly pivotally rotated by a pivot and motor, with a control system provided to properly position the FIG. 38 before a ball is presented to one or both of the hands 42 of the figure through a chute 34.

The above has been offered for illustrative purposes only, and is not intended to limit the scope of the invention of this application, which is as defined in the claims below.

That which is claimed is:

1. A pinball machine which comprises a playfield; a shooter for propelling balls on the playfield; and a figure on the playfield having at least one movable limb, said limb being mounted on a rotatable, generally horizontal shaft, said shaft being rotatably connected to a motor to cause generally vertical pivoting of said limb between a first position where the limb is capable of receiving and holding a ball, and a second position where the ball is propelled from said limb onto the playfield to propel said hall from the limb; a device to retract said limb back to said first position; and a ball delivery trough positioned to deliver balls to said limb in the first position.

2. The pinball machine of claim 1 in which said figure has a pair of said movable limbs.

3. The pinball machine of claim 1 in which a spring urges said limbs and rotatable shaft toward the other of said positions.

4. The pinball machine of claim 3 in which the other of said positions is said first position.

5. The pinball machine of claim 2 in which each limb communicates in the first position with a separate ball delivery aperture, said apertures being defined in a single ball delivery trough, and electrically controllable gates for opening and closing said aperture.

6. The pinball machine of claim 5 in which said apertures are defined in the bottom of said ball delivery trough.

7. The pinball machine of claim 5 in which said electrically controllable gates each comprise a movable flap capable of covering one of said apertures in a first position and capable of permitting a ball rolling in said trough to pass through said one aperture in a second position, and a controller to control the position of said movable flap.

8. The pinball machine of claim 7 in which said controller comprises a motor capable of moving said flap to one of said positions, said flap returning to the other position when the motor is not actuated.

9. The pinball machine of claim 8 in which said apertures are defined in the bottom of said ball delivery trough.

10. The pinball machine of claim 1 in which said figure also has a movable head, and a motor and control for moving said head in a manner responsive to events taking place in the pinball machine.

11. A pinball machine which comprises a playfield; a shooter for propelling balls on the playfield; and a figure having at least one movable limb, said limb being movable between a first position where the limb is capable of receiving and holding a ball, and a second position where the ball is propelled from said limb; said limb being mounted on a generally horizontal, rotatable shaft; a spring urging said limb and rotatable shaft toward the first position; a motor for moving said limb and shaft with generally vertical pivoting of said limb between said first and second positions to propel said ball from the limb; and a ball delivery trough positioned to deliver balls to said limb in the first position.

12. The pinball machine of claim 11 in which said ball delivery trough delivers said balls to said limb through an aperture defined in the bottom of said ball delivery trough.

13. The pinball machine of claim 12 in which said limb communicates in the first position with a ball delivery aperture, said aperture being defined in a ball delivery trough, and an electrically controllable gate for opening and closing said aperture.

14. The pinball machine of claim 13 in which said electrically controllable gate comprises a movable flap capable of covering said aperture in a first position and capable of permitting a ball rolling in said trough to pass through said aperture in a second position, and a controller to control the position of said movable flap.

15. The pinball machine of claim 14 in which said controller comprises a second motor capable of moving said flap to one of said positions, said flap returning to the other position when the second motor is not actuated.

16. The pinball machine of claim 11 in which said figure also has a movable head, and another motor and control for moving said head in a manner responsive to events taking place in the pinball machine.

* * * * *